US007596967B2

(12) United States Patent
Ostfeld

(10) Patent No.: US 7,596,967 B2
(45) Date of Patent: Oct. 6, 2009

(54) ENCRUSTED DIAMOND

(75) Inventor: Shlomo Ostfeld, Rishon Lezion (IL)

(73) Assignee: Camellia Diamonds Ltd, Ramat Gan (IL)

( * ) Notice: Subject to any disclaimer, the term of this patent is extended or adjusted under 35 U.S.C. 154(b) by 219 days.

(21) Appl. No.: 11/585,777

(22) Filed: Oct. 25, 2006

(65) Prior Publication Data

US 2007/0266732 A1 Nov. 22, 2007

Related U.S. Application Data

(63) Continuation-in-part of application No. PCT/IL2006/000604, filed on May 22, 2006.

(60) Provisional application No. 60/685,775, filed on Jun. 1, 2005.

(51) Int. Cl.
*A44C 17/00* (2006.01)
*A44C 17/02* (2006.01)

(52) U.S. Cl. ..... 63/32; 63/26

(58) Field of Classification Search ..... None
See application file for complete search history.

(56) References Cited

U.S. PATENT DOCUMENTS

| | | | | |
|---|---|---|---|---|
| 2,587,972 | A * | 3/1952 | Crise | 63/32 |
| 5,090,216 | A | 2/1992 | Waugh | |
| 5,868,008 | A * | 2/1999 | Yamaura et al. | 63/15 |
| 6,649,009 | B1 * | 11/2003 | Kim | 156/257 |

FOREIGN PATENT DOCUMENTS

| | | | |
|---|---|---|---|
| CH | 649697 | A5 | 6/1985 |
| FR | 1512629 | A | 4/1968 |
| JP | 06327509 | | 11/1994 |

* cited by examiner

*Primary Examiner*—Jack W. Lavinder
(74) *Attorney, Agent, or Firm*—The Nath Law Group; Derek Richmond; Jiaxiao Zhang

(57) ABSTRACT

An encrusted gemstone comprising a base diamond having a crown with a table surface, a pavilion, and a recessed seat in the table surface, an insert diamond having a pavilion matching said recessed seat and set therein, a bore extending axially between a culet of the base diamond and the recessed seat thereof, and a shaft received within said bore, said shaft having a proximal end projecting into the recessed seat and formed with an insert retaining portion, and a distal end projecting from the culet and provided with a securing arrangement.

23 Claims, 3 Drawing Sheets

ENCRUSTED DIAMOND

CROSS-REFERENCE TO RELATED APPLICATIONS

This application is a Continuation-in-part of International Application No. PCT/IL2006/000604, filed May 22, 2006, an application claiming the benefit under 35 U.S.C. § 119(e) of U.S. Provisional Application No. 60/685,775, filed Jun. 1, 2005, the entire contents of which are hereby incorporated herein by reference.

FIELD OF THE INVENTION

This invention relates to gemstones, in particular to encrusted gemstones where one gemstone is inserted into another gemstone.

BACKGROUND OF THE INVENTION

Different concepts and combinations have been used to enhance jewelry. Where small diamonds are involved, it is common to set them in a large metal setting having colors or designs that tend to cause the diamond or other precious stone to appear larger. In other instances, semiprecious stones of relatively large size have contrasting precious stones of relatively smaller size mounted thereon or associated therewith. The contrast may be not only in size, cut and shape, but also in kind and/or color.

U.S. Pat. No. 5,090,216 discloses enhancing a large man-made gemstone such as a zirconia by bonding thereto a precious gemstone such as a diamond. The diamond is selected with a girdle diameter that is slightly less than the width of the crown table of the cubic zirconia. The cubic zirconia has a conical seat ground in its table to match the angle of the diamond pavilion. The conical seat is ground deep enough so that the diamond girdle is just below the crown table surface of the cubic zirconia. The diamond is then glued or cemented into the conical seat with enough glue to slightly cover the crown girdle facets of the diamond.

In the present application and claims the term 'color' will be used in association with naturally or artificially colored diamonds with distinct, attractive tints, and particularly with diamonds having fancy colors, where the grade and value of diamonds increase with color intensity. Among colored diamonds, diamonds with very low transparency (from nearly semitransparent to opaque) are known as 'dark diamonds'. These are considered not to return light and are normally dark gray, very dark green or truly black.

The above use of the term "color" should be distinguished from a very special use of this term in the diamond industry with respect to diamonds returning light (hereinafter 'light color' diamonds), where diamonds are graded by how closely they approach colorless so that a diamond being said to have 'fine color', frequently has no visible color at all. In such 'light' diamonds, the amount of light returned to the eye from a light cut diamond, depends on how well the diamond in question reflects and refracts light including dispersed rays of different wavelengths, which are reflected from the internal surfaces of the diamond.

SUMMARY OF THE INVENTION

In accordance with the present invention, there is provided an encrusted gemstone comprising a base diamond having a crown with a table surface, a pavilion, and a recessed seat in the table surface; and an insert diamond having a pavilion matching said recessed seat and set therein. The base diamond and the insert diamond may be of different colors with the difference readily distinguishable by the eye. The base diamond and the insert diamond may be of different shapes. There may be more than one insert diamonds.

In particular, the base and insert diamonds may be of contrasting colors. In one embodiment of the present invention, the base diamond is of more intensive color than the insert diamond. For example, the base diamond may be of dark color and the insert diamond may be of a light color. In this case, it is preferable that the recessed seat is deeper than the level of the base diamond pavilion. In another embodiment of the present invention, the insert diamond is of more intensive color than the base diamond. For example, the base diamond may be of light color and the insert diamond may be of dark color. In this case, it is preferable that the recessed seat is shallow, i.e. is not deeper than the level of the pavilion of the base diamond. With such a seat, it may be advantageous that the insert diamond pavilion and the seat are frustum-shaped.

In a further embodiment of the present invention, both the base diamond and the insert diamond are of light color, i.e. return light, the insert diamond pavilion and the recessed seat being spherically shaped. In this case, the insert diamond may be set deeper that the level of the pavilion of the base diamond.

The insert diamond may be set by means of a metal setting, for example invisible setting or bezel setting. Alternatively, the insert diamond may be set by means of clear glue. Preferably, the clear glue is UV setting glue.

The encrusted gemstone of the present invention combines a base diamond with one or more insert diamonds in a unique way providing original contrast patterns between diamond colors. Natural light color diamonds may be combined with dark diamonds or with natural or treated fancy diamonds. In particular, dark diamonds may be combined with light color (including colorless) diamonds in an unexpected way creating a new kind of jewels. The contrast pattern may be enhanced by using different shapes of the base diamond and the insert diamond. The shapes may be selected from such popular shapes as round or square or fancy shapes such as, for example, oval, pear, princess, emerald, marquise, cushion, heart, etc.

The encrusted gemstone may further comprise a bore extending axially between a culet of the base diamond and the recessed seat thereof, and a shaft received within the bore and having a proximal end projecting into the recessed seat of the base diamond and formed with an insert retaining portion, and a distal end projecting from the culet of the base diamond and provided with a securing arrangement. The securing arrangement typically has an abutting surface surrounding the shaft, whose largest dimension is larger than that of the bore.

The insert retaining portion may be adapted to provide invisible or bezel setting of the insert diamond in the recessed seat.

The securing arrangement may be in the form of a sleeve having internal threading, with a corresponding portion of the distal end of the shaft being threaded and adapted for screwing engagement with the internal threading of the sleeve. Alternatively, the distal end of the shaft and the securing arrangement may be connected by welding. The distal end of the shaft with its securing arrangement may constitute a functional element of a piece of jewelry.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF EXEMPLARY EMBODIMENTS

Figure 1A:
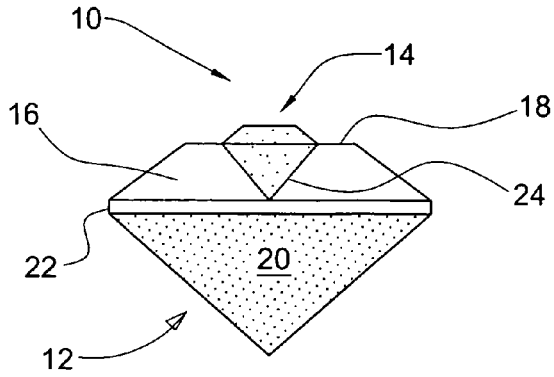
FIG. 1A is a schematic side view of an encrusted gemstone in accordance with one embodiment of the present invention.
Figure 1B:
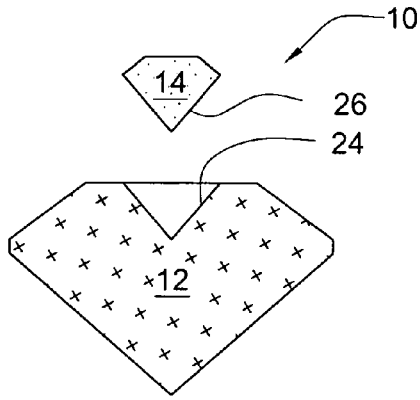
FIG. 1B is a schematic exploded view of the gemstone of FIG. 1A.

With reference to FIGS. 1A and 1B, there is shown in schematic side view and in exploded view an encrusted (enhanced) gemstone 10 comprising a base diamond 12 and an insert diamond 14, in accordance with one embodiment of the present invention.

The base diamond 12 has crown 16 with a table surface 18, a pavilion 20 and girdle 22. The table surface 18 has a recessed seat 24 carved therein. The recessed seat is drilled by means of a laser drill known in the art of diamond processing. After that, final polishing of the diamond facets may be made as necessary.

The insert diamond 14 has a pavilion 26 matching the recessed seat 24. The insert diamond is set in the seat by means of special glue, but may be mounted in metallic setting (see below). Preferably, the base diamond and the insert diamond are of different colors.

For example, the insert diamond 14 may be of more intensive color than the base diamond 12. When the base diamond 12 is of light color, the recessed seat 24 preferably does not go deeper than the higher level of the base pavilion 20; else the brilliancy may be lost.

Figure 2:
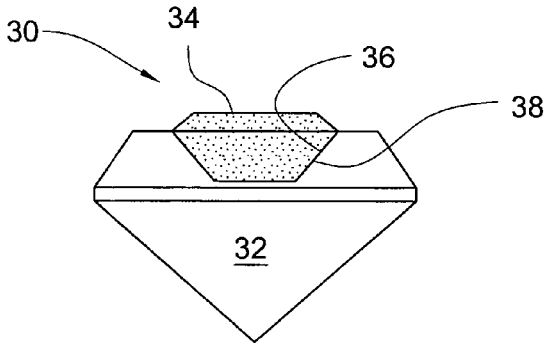
FIG. 2 is a schematic side view of an encrusted gemstone with frustum-shaped insert diamond.

FIG. 2 shows an encrusted gemstone 30 with a light color base diamond 32 and dark color insert diamond 34. The pavilion 36 of the insert diamond 34 and the recessed seat 38 of the base diamond in such case may be frustum-shaped, for the insert diamond to be fully disposed above the pavilion of the base diamond 32. This allows the insert diamond 34 with such a disposition to have a greater area than it could have were its pavilion in the form of a cone with an apex.

Figure 3:
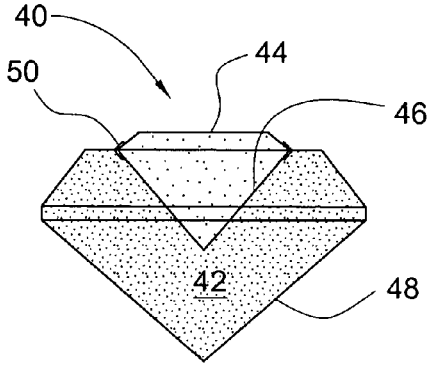
FIG. 3 is a schematic side view of an encrusted gemstone with dark base diamond and deeply set insert diamond.

In the embodiment shown in FIG. 3, an encrusted gemstone 40 comprises a base diamond 42 which is of more intensive color than the insert diamond 44. If the base diamond 42 is of dark color, its recessed seat 46 may be deeper than the higher level of the base diamond pavilion 48. As an example, the insert diamond 44 is shown mounted in metallic bezel setting 50 accommodated in the base diamond 42.

Figure 4A:
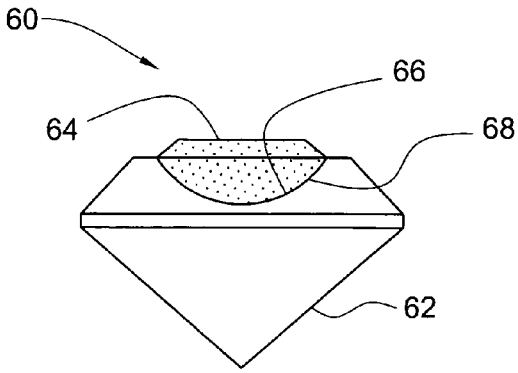
FIGS. 4A and 4B are schematic side views of an encrusted gemstone with spherically shaped interface between the base and the insert diamonds, at different depths.

FIG. 4A shows a further embodiment of the present invention, encrusted gemstone 60, comprising a base diamond 62 and an insert diamond 64. Both diamonds are of light but of different, preferably contrasting colors. The insert diamond pavilion 66 and the recessed seat 68 are spherically shaped and the insert is set by means of clear glue, for example UV setting glue. This arrangement allows light to pass the interface between the diamonds substantially without reflection at the interface, and the difference in the color shades creates original contrasts and play of light.

Figure 4B:
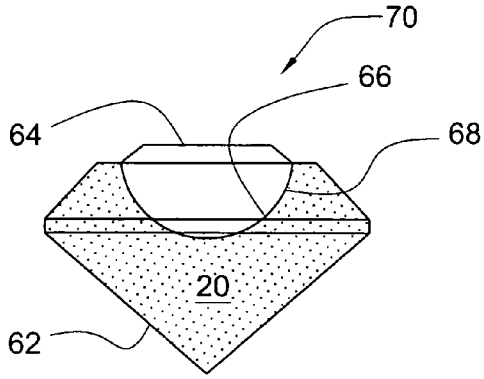

With both the insert and base diamonds being of light color, the insert may be set deeper than the level of the base pavilion 20, as shown in the encrusted gemstone 70 in FIG. 4B.

The base diamond and the insert diamond may be of different shapes, for example a heart-shaped light color diamond encrusted in a dark base diamond of round or emerald shape.

Figure 5A:
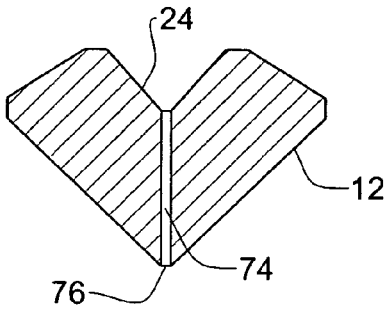
FIG. 5A is a schematic cross-sectional view of a base diamond of an encrusted diamond as part of another embodiment of the present invention.
Figure 5B:
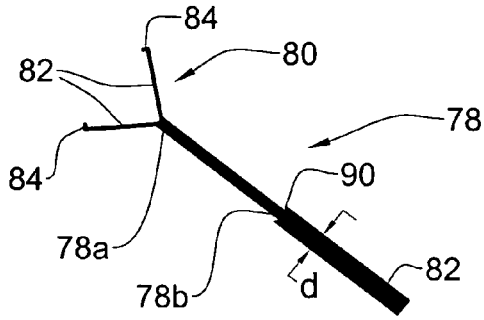
FIG. 5B schematically illustrated a shaft for use with the base diamond illustrated in FIG. 5A.

As illustrated in FIG. 5A, the base diamond 12 may be formed with a bore 74 extending axially from the culet 76 thereof through the center of the recessed seat 24. As illustrated in FIG. 5B, a shaft 78 adapted to hold the insert diamond 14, is inserted through the bore 74. The shaft 78 comprises an insert retaining portion 80 at a proximal end 78*a* thereof, and a securing arrangement 82 at a distal end 78*b* thereof.

Figure 5C:
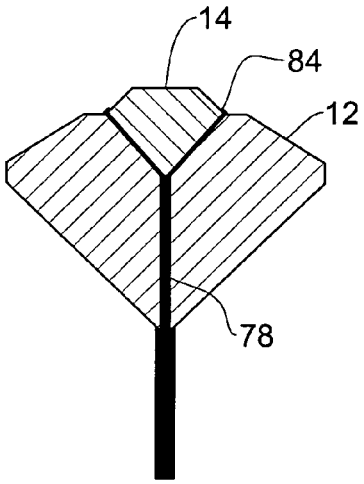
FIGS. 5C and 5D are schematic cross-sectional views of different modifications of the gemstone according to the embodiment illustrated in FIG. 5A.
Figure 5D:
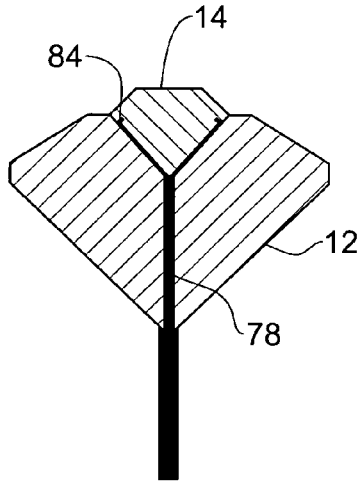

The insert retaining portion 80 may be, e.g., in the form of prongs 82, as illustrated in FIG. 5B, each comprising inwardly (i.e., toward the insert diamond 14) directed ends 84 to retain the insert diamond thereby. The prongs 82 may be adapted to form a bezel setting (FIG. 5C), wherein the inwardly directed ends 84 project above the table of the base diamond 12, when the insert diamond is set within the base diamond, or they may be adapted to form an invisible setting (FIG. 5D), wherein the inwardly directed ends 84 are received within notches (not seen) formed therein, and are not seen when the insert diamond 14 is set within the base diamond 12.

Figure 5E:
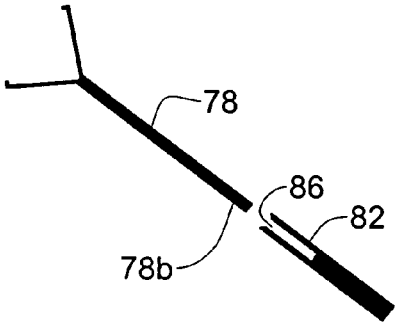
FIG. 5E schematically illustrates the shaft seen in FIG. 5B before assembly.
Figure 5F:
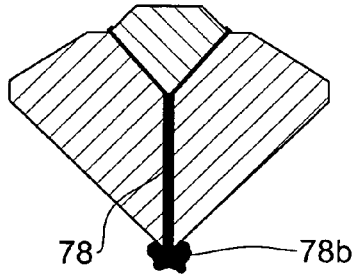
FIG. 5F schematically illustrates the gemstone according to another modification of the embodiment illustrated in FIG. 5A.

The securing arrangement 82 has an abutting surface 90 which has a maximum dimension d which is larger than that of that of the bore 74, (i.e., it is formed so as to be blocked by the portion of the diamond which immediately surrounds and defines the bore, such that prevent entering of the securing arrangement therein is prevented) in order to prevent sliding of the shaft 78 proximally therethrough. The securing arrangement 82 may constitute a separate piece, as seen in FIG. 5E, comprising a cavity 86 adapted to receive the distal end 78*b* of the shaft 78. The arrangement 82 may be affixed on the distal end 78*b* in any appropriate manner, such as by welding, or by forming the two parts with cooperating screwingly engaging portions. Alternatively, as seen in FIG. 5F, the distal end 78*b* of the shaft may be deformed, such as by melting or bending to form the securing arrangement.

Figure 5G:
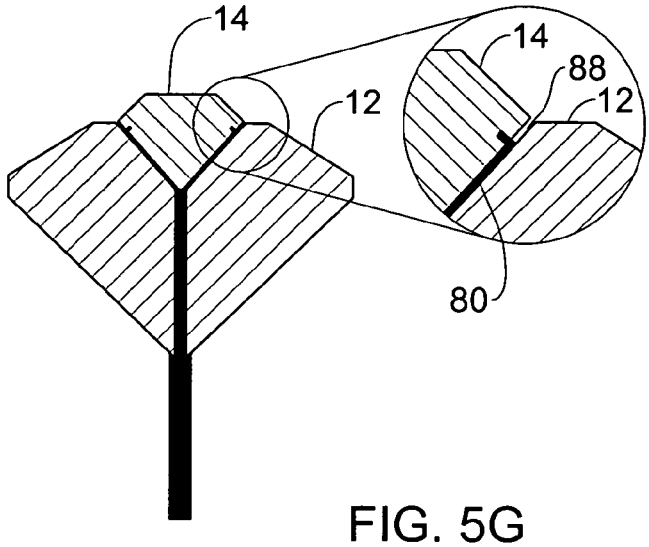
FIG. 5G schematically illustrates the gemstone according to another modification of the embodiment illustrated in FIG. 5A.

As seen sin FIG. 5G, the insert diamond 14 may be set within the base diamond 12 such that there is gap 88 therebetween accommodating the insert retaining portion 80. Alternatively, the insert diamond 14 may be set such that it substantially contacts the base diamond 12, as in FIGS. 5C and 5D. In such a case, grooves (not seen) or another appropriate arrangement adapted to receive therein the insert retaining portion 80 may be formed within the contacting surfaces 12*a*, 14*a* of the base and insert diamonds.

Figure 6A:
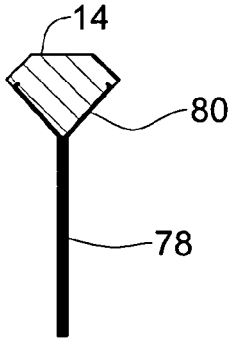
FIGS. 6A through 6C schematically illustrate a sequence for assembling the diamond according to the embodiment illustrated in FIGS. 5A through 5G.
Figure 6B:
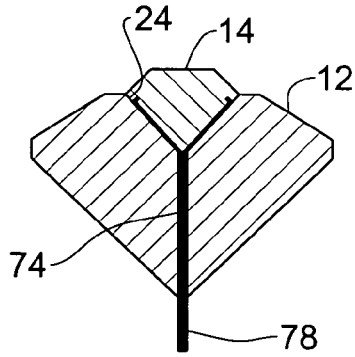
Figure 6C:
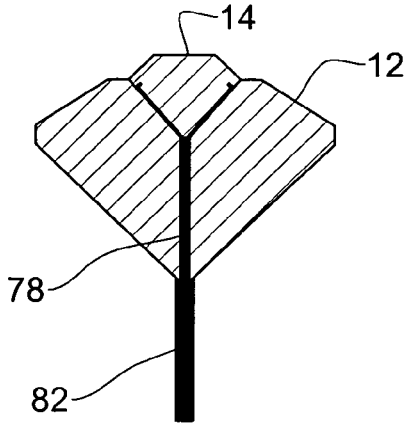

As illustrated in FIG. 6A, during assembly, the insert diamond 14 is typically secured within the insert retaining portion 80 of the shaft 78, before the securing arrangement 82 is attached. As illustrated in FIG. 6B, the distal end 78*b* of the shaft 78 is inserted through the bore 74. As illustrated in FIG. 6C, once the shaft 78 is fully inserted, the securing arrangement 82 is attached or formed, as described above.

The shaft 78 may be formed as an integral part of a piece of jewelry of which the encrusted gemstone 10 is a part. For example, it may constitute the post of an earring, the pin of a pendant, or the post of a cufflink or shirt stud. The shaft 78 may thus serves a dual role, both securely retaining the insert diamond 14 within the recessed seat 24 of the base diamond 12, as well as serving as a functional element of a piece of jewelry.

Those skilled in the art to which this invention pertains will readily appreciate that numerous changes, variations and modifications can be made without departing from the scope of the invention mutatis mutandis.

The invention claimed is:

1. An encrusted gemstone comprising:

(a) a base diamond having a crown with a table surface, a pavilion, and a recessed seat in the table surface;

(b) an insert diamond having a pavilion matching said recessed seat and set therein;

(c) a bore extending axially between a culet of the base diamond and the recessed seat thereof; and (d) a shaft received within said bore, said shaft having a proximal end projecting into the recessed seat and formed with an insert retaining portion, and a distal end projecting from the culet and provided with a securing arrangement.

2. The encrusted gemstone according to claim 1, wherein said securing arrangement has an abutting surface of a diameter which is larger than that of the bore.

3. The encrusted gemstone according to claim 1, wherein said insert retaining portion is adapted for providing an invisible setting of the insert diamond in the recessed seat.

4. The encrusted gemstone according to claim 1, wherein said insert retaining portion is adapted for providing a bezel setting of the insert diamond in the recessed seat.

5. The encrusted gemstone according to claim 1, wherein said securing arrangement comprises a sleeve with internal threading, a corresponding portion of the distal end of the shaft being threaded and adapted for screwing engagement with the internal threading of said sleeve.

6. The encrusted gemstone according to claim 1, wherein said securing arrangement is welded to the distal end of the shaft.

7. The encrusted gemstone according to claim 1, wherein the distal end of the shaft with its securing arrangement constitutes a functional element of a piece of jewelry.

8. The encrusted gemstone according to claim 1, wherein said base diamond and said insert diamond are of different colors.

9. The encrusted gemstone according to claim 8, wherein said base diamond and said insert diamond are of contrasting colors.

10. The encrusted gemstone according to claim 8, wherein said base diamond is of more intensive color than said insert diamond.

11. The encrusted gemstone according to claim 10, wherein said base diamond is a dark diamond.

12. The encrusted gemstone according to claim 11, wherein said recessed seat extends into the base diamond pavilion.

13. The encrusted gemstone according to claim 8, wherein said insert diamond is of more intensive color than said base diamond.

14. The encrusted gemstone according to claim 13, wherein said base diamond is of a light color and said recessed seat is located above the base diamond pavilion.

15. The encrusted gemstone according to claim 14, wherein said insert diamond is of a dark color.

16. The encrusted gemstone according to claim 15, wherein the pavilion of said insert diamond and said recessed seat are frustum-shaped.

17. The encrusted gemstone according to claim 1, wherein said base diamond and said insert diamond are each of light color, the insert diamond pavilion and said recessed seat being spherically shaped.

18. The encrusted gemstone according to claim 17, wherein said recessed seat extends into the base diamond pavilion.

19. The encrusted gemstone according to claim 1, wherein said insert diamond is set by means of a metal setting.

20. The encrusted gemstone according to claim 19, wherein said metal setting is invisible setting or bezel setting.

21. The encrusted gemstone according to claim 1, wherein said base diamond and said insert diamond are of different shapes.

22. An encrusted gemstone comprising a base diamond having a crown with a table surface, a pavilion, and a recessed seat in the table surface; and an insert diamond having a pavilion matching said recessed seat and set therein; said base diamond and said insert diamond being of different colors, wherein said base diamond and said insert diamond are each of light color, the insert diamond pavilion and said recessed seat being spherically shaped.

23. The encrusted gemstone according to claim 22, wherein said recessed seat extends into the base diamond pavilion.

* * * * *